US005937857A

United States Patent [19]

Caterini et al.

[11] Patent Number: 5,937,857

[45] Date of Patent: Aug. 17, 1999

[54] BACKPRESSURE-MODULATING CARTRIDGE FOR BREATHING MASK

[75] Inventors: Richard Caterini, Le May; Gustave Savourey, Biviers, both of France

[73] Assignee: Delegation Generale pour l'Armement, Paris, France

[21] Appl. No.: 08/854,143

[22] Filed: May 9, 1997

[51] Int. Cl.[6] ..... A62B 18/10

[52] U.S. Cl. ..... 128/207.12; 128/207.16; 128/206.15; 128/205.24; 128/205.11

[58] Field of Search ..... 128/207.12, 207.16, 128/206.15, 205.24, 204.26, 204.27, 205.11, 205.17, 205.18, 206.21; 137/505.42

[56] References Cited

U.S. PATENT DOCUMENTS

| | | | |
|---|---|---|---|
| 3,256,898 | 6/1966 | Ringrose . | |
| 3,788,313 | 1/1974 | Arp et al. | 128/204.25 |
| 4,428,392 | 1/1984 | Jones et al. . | |
| 4,625,759 | 12/1986 | Craig | 137/613 |
| 5,071,453 | 12/1991 | Hradeck et al. | 55/21 |
| 5,165,398 | 11/1992 | Bird | 128/204.25 |
| 5,222,479 | 6/1993 | Brauer et al. | 128/202.26 |
| 5,499,624 | 3/1996 | Kruger et al. | 128/204.26 |
| 5,813,401 | 9/1998 | Radcliff et al. | 128/205.24 |
| 5,845,637 | 12/1998 | Knott | 128/207.12 |

FOREIGN PATENT DOCUMENTS

| | | |
|---|---|---|
| 0 325 959 | 2/1989 | European Pat. Off. . |
| 0 566 400 | 10/1993 | European Pat. Off. . |
| 12 65 588 | 4/1968 | Germany . |
| 36 15 664 | 11/1986 | Germany . |

*Primary Examiner*—John G. Weiss
*Assistant Examiner*—Joseph F. Weiss, Jr.
*Attorney, Agent, or Firm*—Oliff & Berridge, PLC

[57] ABSTRACT

A backpressure-modulating cartridge for a breathing mask includes a body defining a first chamber which communicates with the environment, a second chamber which communicates with the mask, and a passage which communicates with the first and second chambers. A guide rod is supported by the body and is disposed in the passage. A movable exhalation valve is supported by the guide rod in the first chamber and has at least one transfer hole opposite the passage. A mechanism is provided for urging the movable exhalation valve into a passage-closing position. A movable inhalation valve is provided which has a surface area that is smaller than a cross-section of the passage. A mechanism is provided for opposing the mechanism for urging such that the movable inhalation valve is urged to close the at least one transfer hole of the movable exhalation valve.

12 Claims, 1 Drawing Sheet

BACKPRESSURE-MODULATING CARTRIDGE FOR BREATHING MASK

BACKGROUND OF THE INVENTION

1. Field of the Invention

The present invention relates to breathing control for subjects suffering from or sensitive to or exposed to hypoxia.

2. Description of Related Art

Although the field of the invention is the set of problems posed by hypoxia, the invention is a modulating cartridge which is particularly intended for subjects sensitive to a high-altitude environment for whom it is important or even absolutely essential to restore or improve their physical performance, to prevent altitude sickness symptoms, particularly the condition known as acute mountain sickness, or to treat the complications induced by such a symptom on an emergency basis.

In the above area, it may be stated that the prior art, based on available publications, does not offer effective solution for combatting hypoxia in healthy subjects, or in subjects with a pathology at sea level.

True, breathing maneuvers that the subject must execute to counteract alveolar hypoventilation, responsible for the symptoms, are known.

Such breathing maneuvers can be termed "pursed lips breathing", inversion of the inspiratory/expiratory phase time ratio, or hyperventilation.

These maneuvers are burdensome for the subject and in actual fact may be ineffective.

Breathing systems exist such as assisted ventilation in intensive care units. These systems are only for patients requiring intensive care.

It may be considered that there is also a system known as a positive expiratory pressure system that includes a module placed on the exhalation side of a breathing valve. This technique is inflexible in use and adjustments must be made according to the subjects and/or area of utilization, and in particular it is unsuitable for use in a high-altitude environment in which it is necessary to preheat the gases breathed in to limit respiratory convection loss, and to humidify these gases to limit dehydration linked to respiratory evaporation.

The technical solutions that may be considered part of the prior art do not offer flexible utilization or effective adaptation options, or even pressure adjustment according to subject, activity, or environment.

SUMMARY OF THE INVENTION

The object of the invention is precisely to bridge the current multifaceted gap by providing a pressure-modulating cartridge with the feature of being easily adaptable to all breathing masks, being easily adjustable particularly in expiratory back-pressure without requiring lengthy, tedious, and delicate disassembly, being light, easy to manufacture and maintain, and withstanding variations in temperature and relative humidity as well as aging over time, particularly under the influence of ultraviolet radiation.

To achieve the above objects, the modulating cartridge according to the invention is characterized in that:

the body defines two successive chambers and communicating through a passage traversed by a guide rod supported by the body, one of the chambers being connected with the environment while the second is connected with the mask, the guide rod supports a movable exhalation valve in a first chamber, said valve being elastically urged into a passage-closing position and having transfer holes located opposite said passage, in the passage, the guide rod supports a movable inhalation valve with a surface area smaller than the passage cross section and antagonistically and elastically urged by the exhalation valve to occupy a position in which the transfer holes of said valve are closed.

Various other characteristics will emerge from the description hereinbelow referring to the attached drawings which show, as a nonlimiting example, one embodiment of the subject of the invention.

DETAILED DESCRIPTION OF THE PREFERRED EMBODIMENTS

Figure 1:
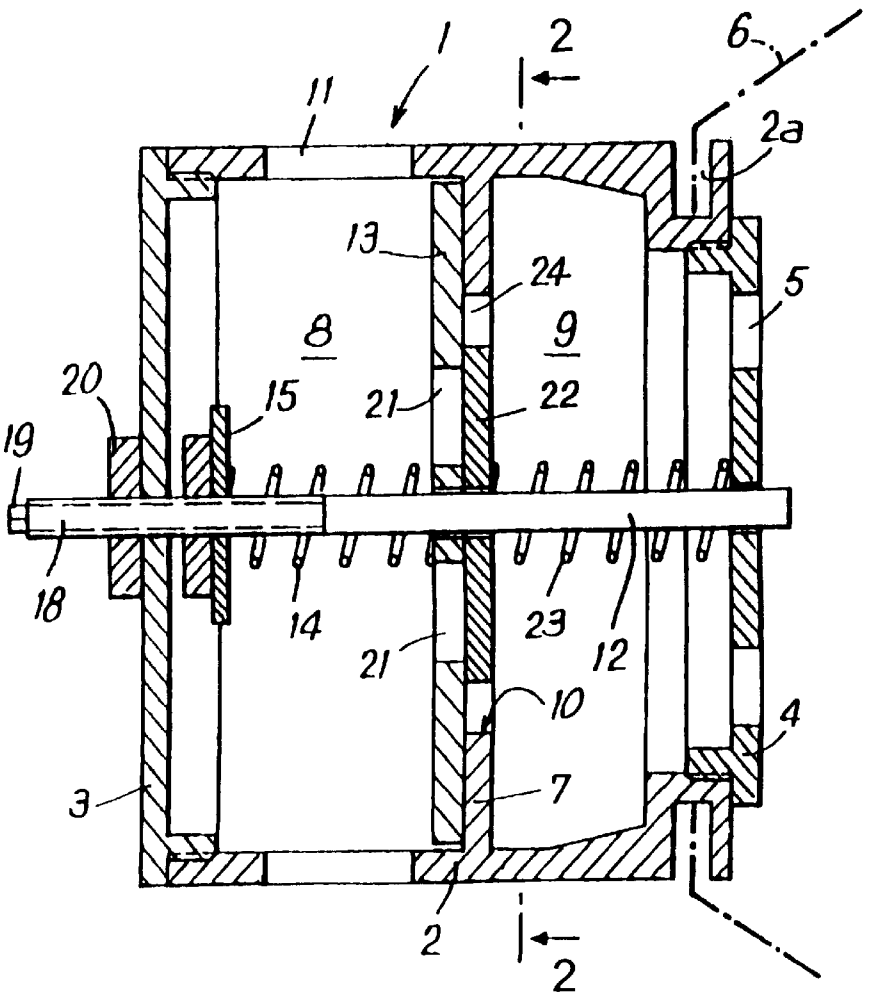
FIG. 1 is an elvational view which shows a modulating cartridge according to the invention.

According to the drawings, the modulating cartridge, designated overall by numeral 1, has a body 2, preferably but not exclusively cylindrical, made of a light material resistant to impacts, variations in temperature, and radiation, particularly ultraviolet radiation, in order to have some resistance to aging. As an example, such a material is preferably chosen from synthetic resin, particularly polytetrafluoroethylene.

Body 2 is closed at both ends by transverse wall elements 3 and 4 which can be made in a single material and be mounted by screwing with the possible addition of seals not shown.

Transverse wall element 3 is preferably made in the form of a lid with a solid wall while transverse wall element 4 can be a simple crosspiece, removable or nonremovable, or a screwable wall element as illustrated in the drawings. In the latter case, the wall element has openings 5 providing a communication between the internal space of body 2 and a mask 6 on which the body is mounted by means of a groove 2*a* or the like that body 2 has in the vicinity of wall element 4.

Body 2 defines interiorly, particularly by use of an annular flange 7, two successive chambers 8 and 9 communicating with each other by a passage 10, circular for example, delimited by flange 7.

Chamber 8, known as the inhalation-exhalation chamber, communicates with the environment through holes 11 preferably provided in the part of the peripheral wall of body 2 corresponding to chamber 8. In certain cases, holes can also be provided in transverse wall element 3.

Chamber 9, known as the transfer chamber, is provided between flange 7 and wall element 4 and communicates with chamber 8 through passage 10 and with mask 6 through openings 5.

Wall elements 3 and 4 support a guide rod 12 which traverses passage 10, being located, in the embodiment shown, concentrically to body 2.

Figure 2:
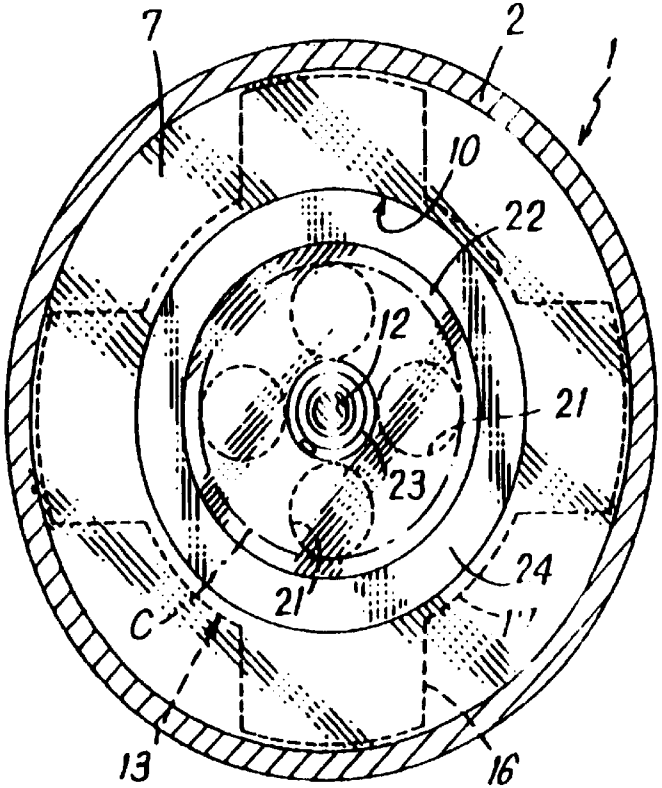
FIG. 2 is a sectional view taken along plane 2—2 of FIG. 1.

In chamber 8, guide rod 12 supports a valve 13 which, in the example illustrated, is freely slidably mounted and elastically urged into the closing position of passage 10. In the example illustrated, the elastic control force is provided by a coil spring 14 threaded concentrically onto the rod and subjected to compressive stress between valve 13 and a stop 15 such that the valve tends always to be applied against flange 7 to close passage 10. For this purpose, as shown in FIG. 2, valve 13 includes a disk made of a thin, low-density material, freely slidable on rod 12, and possibly having legs 16 extending radially from periphery 17 of valve 13. The actual surface area of valve 13, determined by periphery 17, is in all cases slightly greater than the diameter of passage 10.

It is advantageous to make it possible to adjust the elastic force urging valve 13 by modifying the force applied by spring 14. For this purpose, it is possible to render stop 15 axially adjustable on rod 12 which, for this purpose, can have a threaded end part 18 by means of which it can be mounted in transverse wall element 3.

Stop 15 can also be attached to rod 12 which can then be made axially adjustable relative to wall element 3 by means of an appropriately designed end part 19 and a locking means 20 such as a lock nut screwed onto threaded part 18.

Of course, it must be considered that all the equivalent technical mechanisms for assuming the same functions can be provided and chosen according to their objectives such as ease of manipulation, strength, etc.

Exhalation valve 13 is provided with transfer holes 21 that can be circular and regularly distributed and, in all cases, are circumscribed by an imaginary circle C whose diameter is less than the diameter of passage 10.

On the transfer chamber 9 side, guide rod 12 has a valve 22 known as an inhalation valve which includes a low-density disk slidably mounted on rod 12. Valve 22 has a greater surface area than the diameter of the imaginary circle C but a surface aera smaller than the diameter of passage 10 in which it may engage under the action of an elastic prestressing element 23 acting on valve 22 to tend always to urge it against exhalation valve 13 when holes 21 are closed.

The elastic control force exerted by element 23 is, in all cases, less than that exerted by element 14. For example, element 23 is a coil spring threaded onto the part of rod 12 passing through chamber 9 between valve 22 and a stop advantageously constituted by transverse wall element 4.

The diameter of valve 22, in all cases greater than the diameter of C, is chosen such as to leave an annular gap 24, whose function is described below, relative to passage 10.

It must be considered that valve 22 may be subjected to an elastic controlling force adjustable by means that can be formed by a stop mounted for example in an adjustable position on guide rod 12 provided it does not interfere with free axial sliding through element 4.

The operation of the modulating cartridge described above is the following.

When it has been fitted to mask 6, the wearing of the latter by an individual tends to subject the cartridge to alternating variations in pressure relative to the surrounding environment and relative to the mask.

When the individual is breathing in, spring 14 applies valve 13 against flange 7 to close passage 10, and holes 21 are then closed by valve 22.

When the subject breathes in, a negative pressure is established in transfer chamber 9, causing valve 22 to retract against the opposing action of spring 23. The retraction of valve 22 clears holes 21 so that air from the outside is drawn in through holes 11 to penetrate into chamber 8 and pass through holes 21 to traverse passage 10, chamber 9, and holes 5.

When such an inhalation phase ends, the energy stored by spring 23 is restored, so that valve 22 is elastically urged into the position that closes holes 21 inside passage 10, but leaves annular gap 24 relative to this passage.

When the individual moves to the exhalation phase, the pressure rise reestablished in chamber 9 is applied to the part of exhalation valve 13 facing annular gap 24, but valve 13 remains in the closed position for as long as the pressure developed is unable to overcome the elastic control force provided by spring 14.

As soon as this pressure in chamber 9 rises, valve 13 is urged against the action of elastic element 14 to open passage 10 and allow the reverse flow of expired gases which escape after transfer to the outside environment through chamber 8 and holes 11.

As seen from the description of the operation, the elastic control force imposed on valve 13 generates or creates a counterpressure to exhalation which is favorable to establishing good ventilation and a higher oxygenation level than natural breathing.

The counterpressure is adjusted by stop 15 and allows any adaptation according to the current application, which may be combatting hypoxia in healthy individuals in a high-altitude environment, improving oxygenation in healthy individuals at sea level, resuscitating individuals with pathology at sea level, etc.

As stated above, in certain applications, spring 23 may be associated with mechanisms that adjust its elastic control force which, in all cases, counteracts that of spring 14 must operate at a lower level than spring 14. One application may be functional respiratory rehabilitation.

As emerges from the foregoing, the modulating cartridge can easily be made by casting from a synthetic resin chosen for its ability to withstand substantial swings in temperature, impacts, and aging. Such a cartridge can be made in the form of a small module that can easily be sterilized, disassembled, cleaned, and reconditioned where necessary, particularly due to the ease of disassembling the transverse wall elements 3 and 4.

The fact of creating body 2 to delimit two chambers 8 and 9 which are ventilated by alternating inhalation and exhalation streams allows an internal temperature to be maintained by such streams to counteract internal freezing at very low temperatures that could jam either valve 13 or valve 22 in some inappropriate position.

The cartridge is also a module that, particularly when used in a low-temperature environment, has the effect of causing reheating of the gases during the transition and transfer period and hence improving the oxygenation characteristics of the pulmonary alveoli.

The invention is not confined to the example described and shown, as a number of modifications may be made thereto without departing from its framework. In this sense, it should be borne in mind that movable elastically controlled valves 13 and 22 can tilt or pivot rather than slide.

We claim:

1. A backpressure-modulating cartridge for a breathing mask, comprising:

a body defining a first chamber which communicates with the environment, a second chamber which communicates with a breathing mask, and a passage which communicates with the first and second chambers;

a guide rod supported by the body and disposed in the passage;

a movable exhalation valve supported by the guide rod in the first chamber and having at least one transfer hole opposite the passage;

means for urging the movable exhalation valve into a passage-closing position;

a movable inhalation valve supported by the guide rod in the second chamber and having a surface area which is smaller than a diameter of the passage; and means for opposing the means for urging wherein the movable inhalation valve is urged against the exhalation valve to close the at least one transfer hole of the movable exhalation valve.

2. The modulating cartridge according to claim 1, wherein an elastic control force of the means for urging is greater than that of the means for opposing.

3. The modulating cartridge according to claim 1, wherein the elastic control force of at least one of the means for urging and the means for opposing is adjustable.

4. The modulating cartridge according to claim 1, wherein the movable exhalation and inhalation valves are slidably mounted on the guide rod and the means for urging and means for opposing each include a coil spring threaded concentrically onto the guide rod and placed under a compression stress between each valve and a stop.

5. The modulating cartridge according to claim 1 wherein the elastic control force of the means for urging is adjustable by moving a stop.

6. The modulating cartridge according to claim 5, wherein the stop is adjustable on the guide rod.

7. The modulating cartridge according to claim 5, wherein the stop is attached to the guide rod which is axially adjustable relative to the body.

8. The modulating cartridge according to claim 1, wherein the guide rod is supported by transverse wall elements of the body.

9. The modulating cartridge according to claim 1, wherein the guide rod extends concentrically relative to the body.

10. The modulating cartridge according to claim 1, wherein the body has an internal annular flange that defines the passage and operates as a stop for the movable exhalation valve which is subject to the elastic control force of the means for urging.

11. The modulating cartridge according to claim 1, wherein the movable inhalation valve has a diameter greater than a diameter of a circumference of the at least one transfer hole.

12. The modulating cartridge according to claim 1, wherein the movable inhalation valve has a smaller diameter than that of the passage such that an annular gap is defined when the movable exhalation valve is disposed in the passage-closing position.

* * * * *